US005232087A

United States Patent [19]

Schluger

[11] Patent Number: 5,232,087

[45] Date of Patent: Aug. 3, 1993

[54] COMBINATION PRODUCT TRANSMITTAL PACKAGE AND GREETING CARD

[76] Inventor: Allen Schluger, 21 W. 68th St., New York, N.Y. 10023

[21] Appl. No.: 946,606

[22] Filed: Sep. 21, 1992

[51] Int. Cl.[5] ..... B65D 51/00

[52] U.S. Cl. ..... 206/45.29; 206/45.28; 206/45.3; 206/45.31; 206/232; 206/387; 206/424; 40/124.1

[58] Field of Search ..... 206/45.28, 45.29, 45.3, 206/387, 424, 459.5, 216, 232; 40/124.1

[56] References Cited

U.S. PATENT DOCUMENTS

| | | | |
|---|---|---|---|
| Re. 33,503 | 12/1990 | Schluger | 206/45.29 |
| 1,234,421 | 7/1917 | Tinsley | 206/45.3 |
| 2,067,660 | 1/1937 | Eiseman | 206/45.29 |
| 2,894,618 | 7/1959 | Matteson | 206/45.28 |
| 2,964,233 | 12/1960 | McFarland | 206/216 X |
| 3,380,644 | 4/1968 | D'Alessio | 206/424 X |
| 4,433,780 | 2/1984 | Ellis | 206/232 |
| 4,834,889 | 3/1984 | Fery | 206/216 |
| 5,038,930 | 8/1991 | Holtkamp, Jr. | 206/232 |
| 5,096,058 | 3/1992 | Juravin et al. | 40/124.1 |

*Primary Examiner*—Steven N. Meyers
*Assistant Examiner*—Ted Kavanaugh

[57] ABSTRACT

A rectangular box bounding a compartment used for mailing a gift having left and right laterally extending panels and two modes of use, in the first use mode the left panel functions as a greeting card, facilitated in this respect by the right panel being effectively placed in an out-of-the-way position, and in the second use mode the right panel is folded from its out-of-the-way position to an operative position providing protection against breakage, etc., for the gift, to thereby contribute to the use of the rectangular box as a mailer.

2 Claims, 3 Drawing Sheets

COMBINATION PRODUCT TRANSMITTAL PACKAGE AND GREETING CARD

The present invention relates generally to improvements for packages, in the specific form of a rectangular box as typically used for sending products through the mail, and more specifically to such improvements which promote the use of the within package specifically for gift-type products for which the package has a greeting card mode of use for conveying salutations and like messages to the recipient.

Example of the Prior Art

It is already recognized, as exemplified by prior U.S. Pat. No. 4,433,780 issued to Karen E. Ellis on Feb. 28, 1984, that a package for transmitting a gift item, such as a standard audio cassette, has enhanced commercial value if it also conveys salutations or other typical greeting card messages to the recipient. There is, therefore, provided in the construction of this package a panel pre-printed, as at 58, to serve as a greeting card, but which panel is not presented as such until the package is opened to obtain access to the transmitted audio cassette. Thus, this package does not actually have two clearly distinct modes of use, namely one as a greeting card, and also one as an effective transmittal container for a gift product.

Broadly, it is an object of the present invention to provide a combination product transmittal package and greeting card overcoming the foregoing and other shortcomings of the prior art. More particularly, it is an object to provide a package in one folded configuration to serve as a greeting card, and in another folded configuration, in which all the available panels are in covering relation to provide maximum protection to the product against breakage during transit, to serve as an effective mailer.

The within inventive package is an improvement of the package of my prior U.S. Pat. No. 33,503 issued on Dec. 25, 1990, in connection with which, by this reference, the illustration and description thereof is incorporated herein in full. More particularly, it is of the type in which pre-printed plural panels of a die-cut cardboard or similar construction material blank are folded from the flat into a rectangular gift item box. Held in a read position establishes a vertical orientation to the opposite sides of the printed box top panel and, of course, a correspondingly horizontal orientation to the top and bottom edges of this panel. Cooperating with a centrally located box, and as already embodied in my prior patented package, are a first and a second additional panel each connected respectively to the opposite vertical sides of the box top panel. Heretofore not known and constituting the patentable advance, is using to advantage the left or first said panel to serve a gift card function, and the right or second said panel to optionally assume an out-of-the-way position during this use as a gift card, and also to assume a position in covering relation over the box top panel, itself folded over the said first panel, to thereby effectively convert the within package into a mailer or product transmittal container.

The description of the invention which follows, together with the accompanying drawings, should not be construed as limiting the invention to the example shown and described, because those skilled in the art to which this invention appertains will be able to devise other forms thereof within the ambit of the appended claims.

Figure 5:
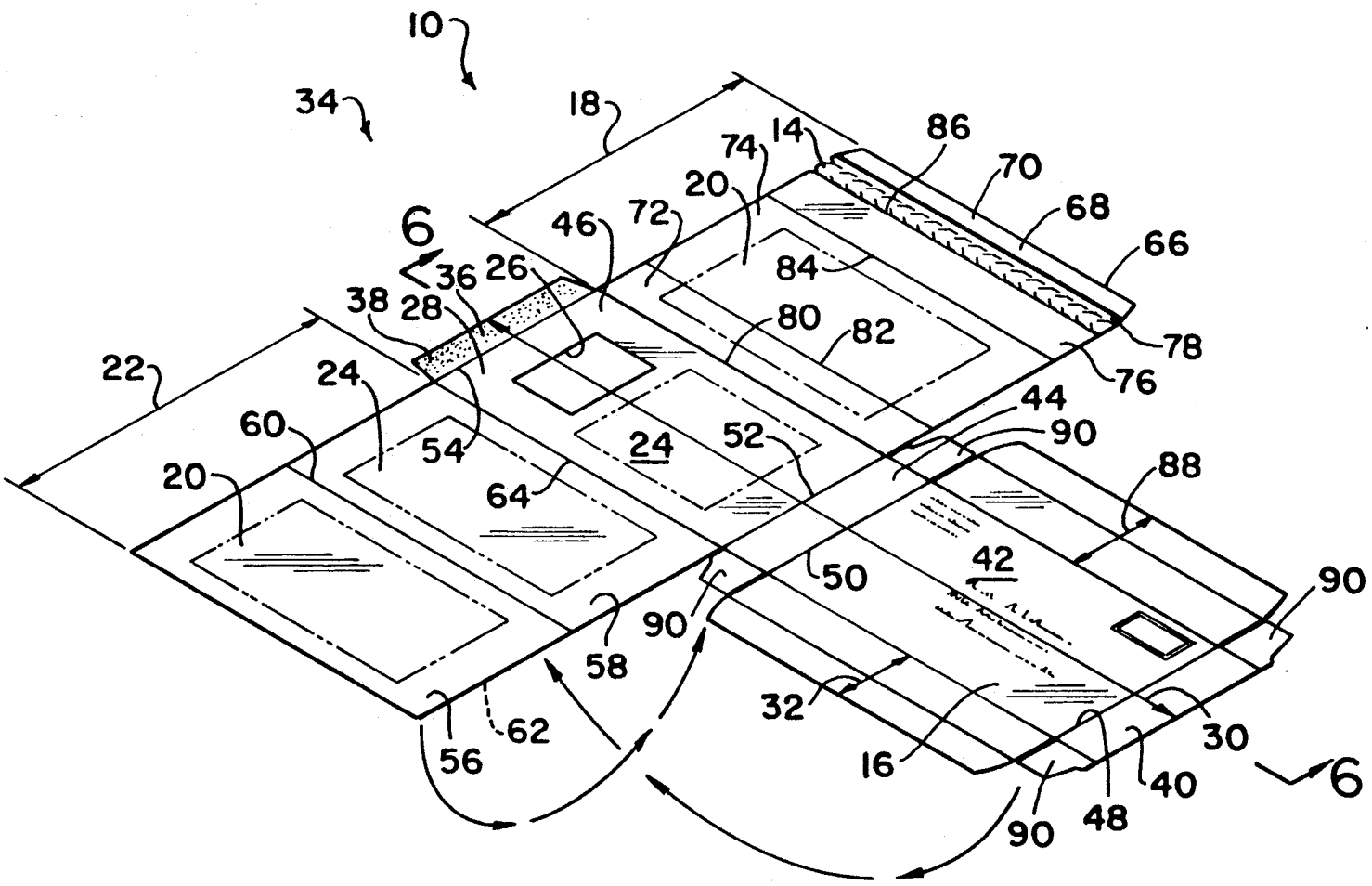
FIG. 5 is a perspective view showing the within inventive package in its initial condition as a blank and from which the folding of the various panels provide the three dimensional configuration of FIGS. 1–4.
Figure 6:
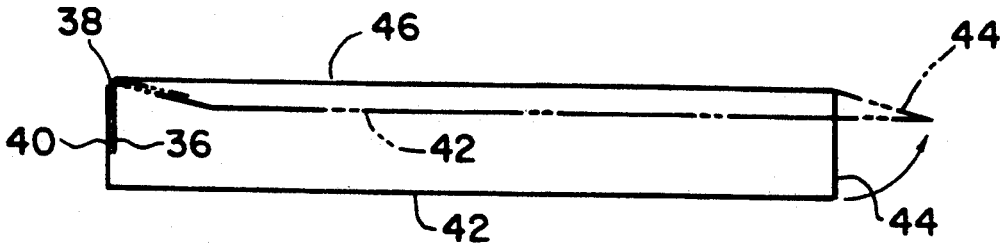
FIG. 6 is a view as seen along line 6—6 of FIG. 5, but illustrating the blank of FIG. 5 in a three dimensional configuration.

Before proceeding with a detailed description of the within inventive package, it is believed helpful to refer to FIG. 5 which illustrates the blank, preferably of cardboard construction material, from which the package is constructed. In this drawing figure it is easier to identify the various panels and fold lines of the package, particularly in relation to the nomenclature used in referring to these structural features in the appended claims. More particularly, at the left of FIG. 5 there is designated a panel 20 which will be understood to be folded upon panel 24 along the fold line 60 to thereby form a two-ply panel identified as panel 22 which has folding movement about a fold line 64. Instead of being two plies, it will, of course, be readily understood that panel 22 could be a single ply and would, therefore, consist only of the panel 24.

Figure 3:
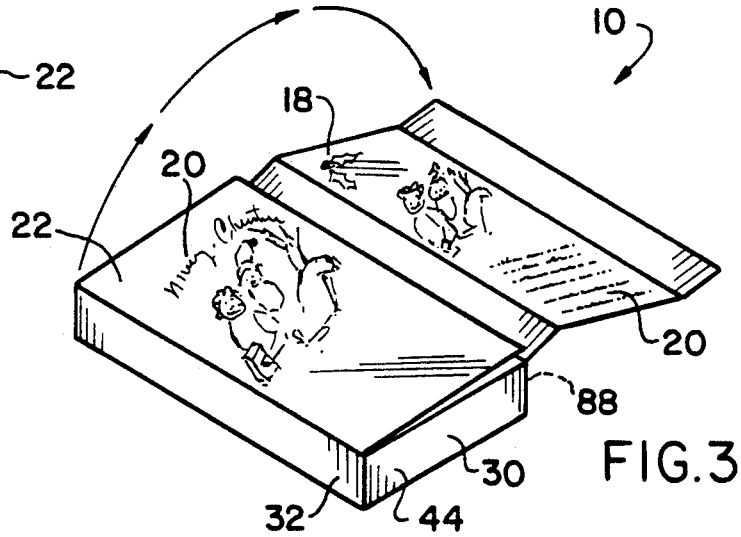
FIG. 3 is a perspective view illustrating the unfolding of the within inventive package from its condition illustrated in FIG. 1 to a condition which permits the insertion of the product and the subsequent use as a mailer as illustrated in FIG. 2.
Figure 4:
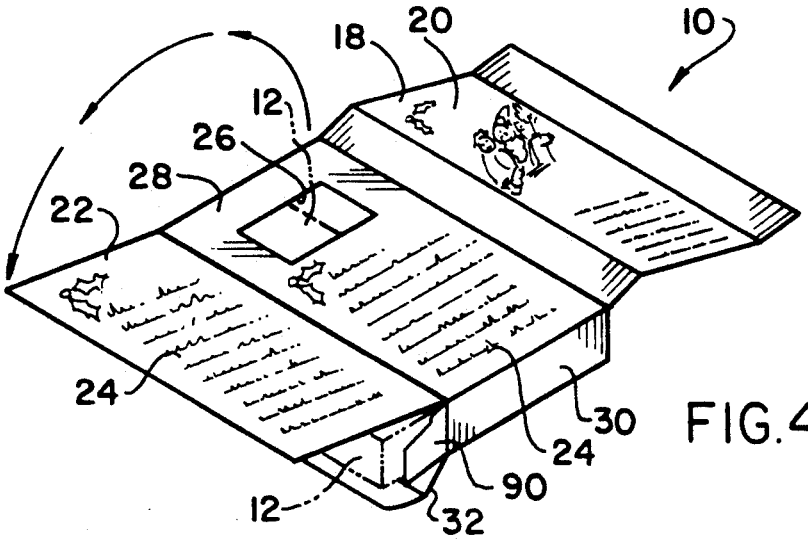
FIG. 4 is a perspective view of the package showing in greater detail the unfolding of panels thereof which enable its conversion from its greeting card condition of FIG. 1 to the mailer condition of FIG. 2.

Connected to panel 24 at the fold line 64 are plural panels as exemplified by panels 28, 44 and 16 which cooperate with each other so as to be operatively arranged into a rectangular box designated 30 in FIGS. 2, 3 and 4 which, as will be subsequently described in detail, bound a rectangular compartment in which it is contemplated there will be placed an appropriately sized product for transmittal to an addressee when the within package 10 is used as a mailer.

Still referring to FIG. 5, there should be readily identified at the fold line 80 on the right side of panel 28 when it serves as the top panel of the box 30 another what is herein referred to as a second additional panel 74 which has a first dimension 72 delineated by a fold line 82 spaced in a clearance position from fold line 80 along the left side of panel 74. A counterpart of the first delineated dimension 72 is a second delineated dimension 76, of equal size, which is delineated by fold line 84 in a clearance position from the opposite edge of panel 74. In the embodiment illustrated, adjacent the second delineated dimension 76 is an outer edge portion 66 which is preferred, but not essential, to the within invention. That is, the second additional panel herein designated 18, will function in accordance with the present invention even if this panel terminates at the fold line 86 and, therefore, does not include the edge portion 66. What is essential to the within invention is that, in its widthwise size, panel 18 meets the following criteria, namely, that the width portion thereof, which includes the first delineated dimension 72, and the portion of the panel up to the fold line 84 is equal to the width of the box top panel 28, and panel 18 also as measured in the opposite direction wherein it includes the second delineated dimension 76 and the remainder thereof up to the fold line 82 is also identical to the width of the box top panel 28. The significance of this will soon be apparent.

Also as may best be noted from FIG. 5, box 30 that is constructed from the plural panels situated between the fold lines 64 and 80 has a selected depth which in size is the width of the panels 44 and 40 and the corresponding portions of the box flaps 32 and 88. The size of the first and second delineated dimensions 72 and 76 of the second additional panel 18 is selected to match this noted depth of the box construction 30. As a consequence, and as will be more fully explained subsequently, the second panel 18 is thus adapted to be folded in a clockwise direction about the fold line 80 positioning its first delineated dimension 72 against a side of the rectangular box 30 and the remainder thereof in an out-of-the-way position against the box bottom panel 16. This is more particularly shown in the cross-sectional view of FIG. 7.

The second additional panel 18 also is adapted to be folded in an opposite counter-clockwise direction positioning its second delineated dimension 76 against the opposite side of the box 30 with the remainder thereof disposed in a covering relation over the first additional panel 22 in its position folded against the box top panel 28. This condition is more particularly illustrated in the cross-sectional view of FIG. 9.

Figure 1:
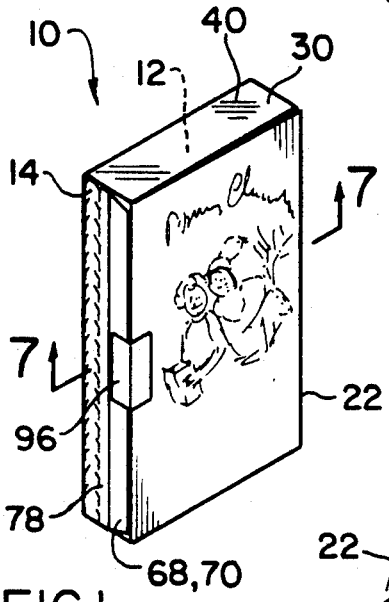
FIG. 1 is a perspective view of the within inventive package in a condition in which panels thereof serve as a greeting card and preparatory to the insertion of a selected product therein.

Proceeding now with a detailed description of the within inventive combination transmittal box and greeting card, reference should be made to FIG. 1 in which the within inventive package is generally designated 10 and will be understood in FIG. 1 to be shown in its condition emphasizing its use as a greeting card. In this regard, the package 10 is intended to be sold in retail stores with or without any contents 12. In either case, display information (not shown) and suitable identification (not shown) on the package 10 are intended to disclose to a prospective purchaser, before purchase, the text, contents therein and manner of use.

Figure 2:
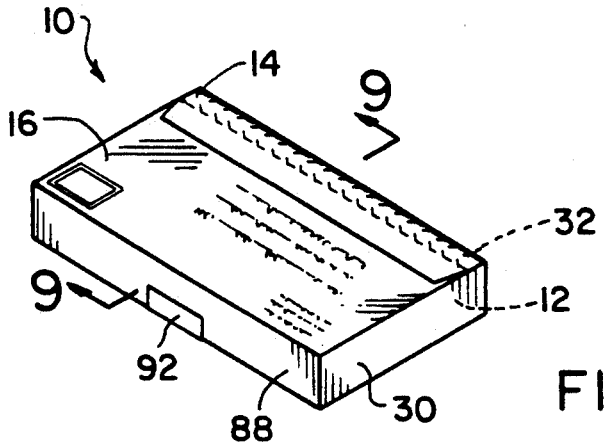
FIG. 2 is also a perspective view of the within inventive package after there typically has been the insertion of a product therein and preparatory to the use of the package as a mailer.

In FIG. 2, the package 10 is shown in its condition to be used as a mailer by a purchaser thereof. As such, the purchaser first opens zip strip 14 and then inverts the package so that the address side 16 faces downward. When flap 18 is turned back a typical greeting card format 20 will be displayed, as illustrated in FIG. 3. Proceeding now to FIG. 4, it will be noted that the unfolding of flap 22 as illustrated in this figure will also expose a space for a personal hand written message 24 which it is contemplated will be placed thereon by the purchaser or sender. When appropriate, a cutout 26 is provided in the upper box top panel 28 of the box structure 30 of the package so that through the cutout 26 there will be a partial display of the contents within a compartment 12 which is provided by the box structure 30. Access to the contents 12 of the box 30 is readily achieved when removing the tuck flap 32, it being understood that the tuck flap 32 is itself made available for removal when the panel 18 is unfolded in the clockwise direction illustrated in FIG. 3.

Referring again to FIG. 5, it will be understood that illustrated therein is a basic pasteboard or cardboard flat blank or form 34 from which the package 10 is constructed. The blank of FIG. 10 is illustrated after conventional printing, die cutting or embossing of the fold lines which permit the folding of the blank into a three dimensional package in accordance with well understood practice. It is to be noted, however, that blank 34 is arranged so that printing need only be done on one side, although, if required for a particular end use, the blank may also printed on it s opposite surface.

During manufacture of a preferred embodiment of the within invention, the box section 30 of package 10 is formed by applying an appropriate adhesive or glue 38 to tab 36 and folding adjacent panels 40, 42, 44 and 46 about, as best shown in FIG. 5, fold lines 48, 50, 52 and 54.

In the embodiment illustrated, to form the first additional flap or panel 22, a first panel 56 is folded under a second panel 58 along a fold line 60 and held together in a two-ply construction by glue 62 placed therebetween. In use, panel 22 is further folded over panel 46 which serves as the top panel of the box 30. The use of a double ply construction for panel 22 allows for the printing on only one side of the flat blank 34, but provides by the double ply construction the additional strength that might be required of the package 10 when used as a mailer.

Along the outer edge 66 of the flap or second additional panel 18 is a strip of double sided tape 68 which is intended to be used in the location indicated for premail sealing of the package. The protective cover paper 70 is left in place until the sender is ready to seal package 10. Flap or panel 18 is comprised of adjacent panel length portions 72, 74, 76 and 78 which are delineated from each other by the fold lines 80, 82, 84 and 86. In a preferred embodiment the extension 78 to the panel 18 includes a zip strip 14 with previously located die-cuts therein which permit its ready removal which, in a well understood manner, detaches the extension 78 from the edge of the panel 18.

In its original blank condition or form, as a second additional panel or flap 18 is merely folded about the fold line 80 over flap 22 in order to provide a compact or storage condition of the within package. However, in the use of the package 10 hereof as a mailer, the panels have to be unfolded into a three dimensional rectangular box construction 30. In this condition, and possibly after the user first writes a message on areas 24, the erected box section 30 is used for the insertion of an appropriately sized gift item. To this end, opposite the tuck flap 32 of panel 42 is a similar tuck flap 88. These tuck flaps 32 and 88 are each flanked by a pair of support tabs 90. To construct the box section 30, the tabs 90 are first folded inward, then tuck flaps 32 and 88 are folded and inserted in a well understood manner to enclose the gift contents 12 in a compartment bounded by the panels, all as may be readily understood from the cross-sectional view of FIG. 7.

Figure 9:
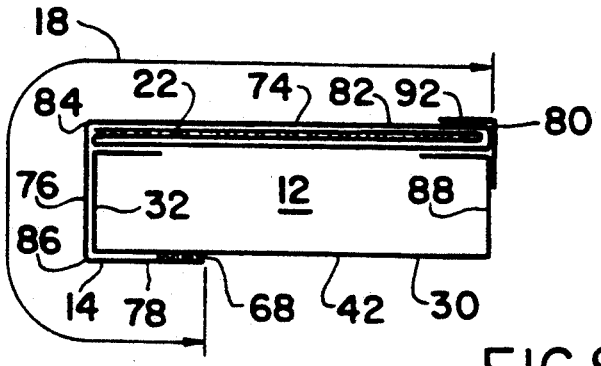
FIG. 9 is a schematic cross-sectional view taken along line 9—9 of FIG. 2 showing details of the package when serving as a mailer.

To seal the package 10 preparatory to mailing, the user removes protective paper 70 from the double sided tape 68 and wraps or folds the additional panel 18 in a counter-clockwise direction snugly about the box section 30 thereby using the panel 18 as an enclosing cover over the first additional flap or panel 22, using the adhesive connection of tape 68 to retain flap 18 in this condition, all as may be readily appreciated from the cross-sectional view of FIG. 9. Tuck flap 88 is sealed with a length of tape 92 or otherwise secured in place in contemplation of the use of the package 10 as a mailer. In this regard, package 10 is completed as a mailer merely by applying postage and writing in the address of the addressee on the exposed surface of panel 74.

Figure 7:
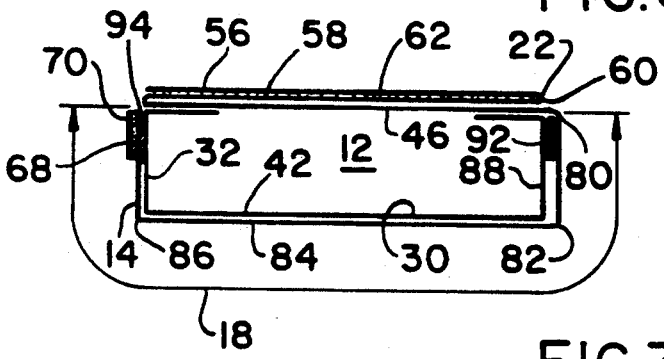
FIG. 7 is a cross-sectional view of the package of FIG. 1 as seen along lines 7—7 of FIG. 1.
Figure 8:
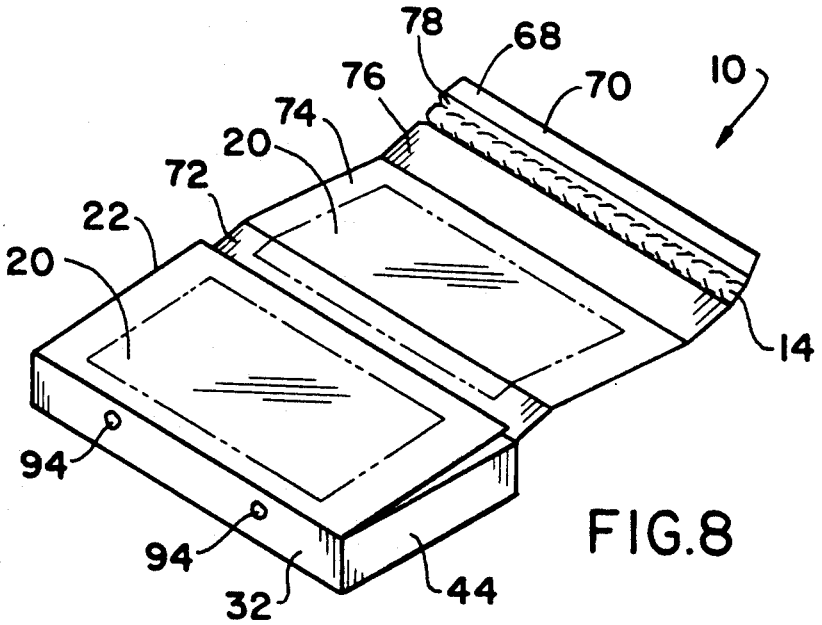
FIG. 8 is a perspective view of the within inventive package just prior to the final folding step which converts the package into a mailer.

For completeness sake, it is noted that when package 10 is used commercially as a combination greeting card, gift wrap and mailer, the package 10 is forwarded to a point of use in bulk and preferably in a flat, compact condition. It is contemplated that the recipient will use the blank 34 by constructing from it a box section 30 and inserting an appropriate gift 12 within this box section. The box tuck flap 88 will be held in place by a double-sided adhesive tape 92. As perhaps may best be appreciated from FIG. 8, a pair of glue drops 94 are strategically placed on the face of tuck flap 32 (FIG. 8) to hold in place panel 18 following its clockwise folded movement into its out-of-way position beneath the box body panel 42, as seen in FIG. 7. Ultimately, an additional edge extension 66 on panel 78 (FIG. 5) may be held in place with a peelable seal 96 on which printing instructs the user to open panel 78 by breaking the glue seals 94 and not to use the zip strip 14. This particular alternate use of package 10 is illustrated in FIG. 1 and is a contemplated condition in which it might be sold in retail stores where the purchaser can lift flap 22 to read the greeting card portion prior to making a purchase selection.

Again, for completeness sake, it is noted that the package 10 can be manufactured in standard sizes which are adapted to receive therein video cassettes or popular sized hard cover books, Corrugated cardboard inserts (not shown) can be used to reinforce the strength of box 10 and also to prevent breakage of fragile gift items such as candy traps, audio cassettes, perfume bottles, jewelry and other general merchandise that might be selected as the contents 12 for the within package.

While the package providing the double function of a greeting card and a product transmittal container exemplified by the package 10 herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A combination product transmittal package and greeting card comprising plural panels operatively arranged into a rectangular box of a selected depth bounding a correspondingly rectangular compartment to receive therein a product for transmittal, two of said plural panels serving as an oppositely disposed top and bottom panel of such box and each of an identical rectangular size having a selected sized horizontal pair of edges and a selected sized vertical pair of edges, an additional rectangular first panel pivotally attached along a left vertical edge of said box top panel adapted to cooperate with said box top panel to serve as a greeting card for said package, and an additional rectangular second panel pivotally attached along a right vertical edge of said box top panel of a selected size widthwise to optionally allow said greeting card service of said first panel and also to serve as a closure thereover during use of said package for product transmittal, said widthwise size of said second panel consisting of a first dimension delineated by a first fold line located in a clearance position from said box top panel right vertical edge that is equal to said depth of said box, an identical box depth-sized second dimension delineated by a second fold line located in a clearance position from an opposite edge of said second panel, and the remaining width of said second panel located between said first and second fold lines being equal to the width of said box top and bottom panels less said depth of said box, whereby said second panel is adapted to be folded in a clockwise direction positioning said first delineated dimension thereof against a side of said box and the remainder thereof in an out-of-the-way position against the box bottom panel, and also adapted to be folded in a counter-clockwise direction positioning said second delineated dimension thereof against an opposite side of said box with the remainder thereof disposed in covering relation over said first panel in its position folded against said box top panel.

2. The combination product transmittal package and greeting card as claimed in claim 1 wherein said additional second panel has an additional lip portion extending from said second dimension delineated thereon to enhance the attachment of said second panel in its clockwise and counter-clockwise positions, and a removable strip at an interposed location between said lip portion and said delineated second dimension for releasing said second panel from an attached position thereof.

* * * * *